US005694996A

United States Patent [19]

Vigenberg et al.

[11] Patent Number: 5,694,996

[45] Date of Patent: Dec. 9, 1997

[54] SCREENING ARRANGEMENT FOR A WINDOW

[75] Inventors: Stig Flemming Vigenberg, Gilleleje; Brent Møller, Gentofte, both of Denmark

[73] Assignee: V. Kann Rasmussen Industri A/S, Søborg, Denmark

[21] Appl. No.: 666,440

[22] PCT Filed: Jan. 27, 1995

[86] PCT No.: PCT/DK95/00039

§ 371 Date: Jan. 26, 1996

§ 102(e) Date: Jan. 26, 1996

[87] PCT Pub. No.: WO95/20715

PCT Pub. Date: Aug. 3, 1995

[30] Foreign Application Priority Data

Jan. 28, 1994 [DK] Denmark ..... 0126/94

[51] Int. Cl.[6] ..... A47H 1/00

[52] U.S. Cl. ..... 160/93; 160/84.04

[58] Field of Search ..... 160/93, 92, 94, 160/96, 97, 84.04

[56] References Cited

U.S. PATENT DOCUMENTS

| | | | |
|---|---|---|---|
| 1,022,870 | 4/1912 | Power | 160/92 |
| 1,211,053 | 1/1917 | Bernard | 160/92 |
| 2,261,941 | 11/1941 | Persson | 160/93 X |
| 2,270,202 | 1/1942 | Persson | 160/93 X |
| 2,311,413 | 2/1943 | Persson | 160/94 X |
| 5,179,988 | 1/1993 | Vorsmann . | |

FOREIGN PATENT DOCUMENTS

| | | |
|---|---|---|
| 527915 | 12/1991 | Australia . |
| 2622170 | 11/1977 | Germany . |
| 4026236 | 3/1991 | Germany . |
| 4218088 | 10/1993 | Germany . |
| WO9311332 | 6/1993 | WIPO . |

*Primary Examiner*—David M. Purol

*Attorney, Agent, or Firm*—Lane, Aitken & McCann

[57] ABSTRACT

A screening arrangement for a window with a main frame and a glass-carrying frame journalled in the main frame, the glass-carrying frame being movable to a ventilating position, in which the glass-carrying frame plane forms an angle with the main frame plane, so that at least one wedge-shaped ventilation aperture is formed between the main frame and the glass-carrying frame, the screening arrangement comprising an air-permeable insect screen, which in a mounted position has three wall-like sections for screening the wedge-shaped ventilation aperture, the insect screen being folded into a bellows surface having an outer and an inner end fold, the inner end fold being connected with the main frame and the outer end fold being carried by a screen-carrying, separate frame connected with the main frame by hinges for mounting on the outside of the glass-carrying frame. The screen-carrying frame is displaceably connected with the glass-carrying frame at a distance from its hinged connection with the top member of the main frame. The screening arrangement may furthermore comprise a screening situated in the plane of the screen-carrying frame, which screening is preferably a roll-up screening.

14 Claims, 3 Drawing Sheets

SCREENING ARRANGEMENT FOR A WINDOW

BACKGROUND OF THE INVENTION

The invention relates to a screening arrangement for a window with a frame-shaped main frame designed for fixed installation in a roof or wall opening and a glass-carrying frame journalled in the main frame, which frame from a closed position, in which the frame is in a plane parallel to that of the main frame, can be moved to a ventilating position, in which the frame plane forms an angle with the main frame plane, so that at least one wedge-shaped ventilation aperture is formed between the main frame and the frame, said screening arrangement comprising an air-permeable insect screen, which in a mounted position comprises three wall-like sections for screening the rectangular and the two triangular side faces, respectively, of the wedge-shaped ventilation aperture, each section of the insect screen being folded into a bellows surface having an outer and an inner end fold, the inner end fold being connected with the corresponding main frame member and the outer end fold being carried by a frame connected to the main frame by hinges. From AU-B-527915 and DE-A-26 22 170 it is known to provide a top-hung window with an insect screening, which in the open position of the window covers the lateral faces of the wedge-shaped ventilation aperture and which in the closed position of the window is accommodated in a cavity between the main frame and the frame. As the entire frame turns outwards when opening the window, the ventilation aperture may be covered by a single insect screen.

In case of pivoting windows, in which the glass-carrying frame is journalled in the main frame at its central axis, such a construction cannot be applied, as one half of the frame turns outwards, as in the before mentioned case, whereas the other half turns inwards when opening the window.

Instead, it is suggested to use inside insect screenings, which for instance are placed some way into the embrasure. Such a solution is simple and inexpensive but will generally impede access to the operating handle of the window, so that the window cannot be opened without wholly or partly removing the screening. In addition to the more difficult operation of the window, there is also the risk that insects will enter the room during the time elapsing from the window is opened until The screening has been mounted or vice versa.

Furthermore, it has been suggested in U.S. Pat. No. 2,311,413 to use two sets of insect screens in case of pivoting windows, each set being mounted between the frame and the main frame and each covering one of the two wedge-shaped ventilation apertures. The arrangement illustrated in this may screen the window during the entire opening process, but in connection with the mounting it requires relatively large interventions in the main frame and/or the frame.

From DE-A-40 26 236 a window is known in which a fixed screening is mounted on the inside of the window without any connection to the moveable window frame. The screen is thus always folded out and projects into the room. Both in case of top-hung and pivoting windows, it is desirable to be able to produce the main frame and the frame in the same way, whether or not the window is to be sold with an insect screen. The main frame and the frame should also have as high a strength as possible for obtaining a fixed outer dimension, which makes it desirable to avoid an inner cavity between the main frame and the frame.

SUMMARY OF THE INVENTION

The object of the invention is therefore to provide a screening arrangement which offers adequate security against entry of insects and which can be mounted on the main frame and the frame by quite insignificant interventions, which do not require preparation of cavities etc. in places in which the weatherproofing of the window is situated. Furthermore, it is an object to provide an arrangement which in a simple way can be mounted on already built-in, old windows.

In this respect, the screening arrangement in accordance with the invention is characterized in that the screen-carrying frame is a separate frame for mounting on the outside of the glass-carrying frame and in that the screen-carrying frame in a distance from its hinged connection with the top member of the main frame is displaceably connected with the glass-carrying frame.

In practically all windows, the top member of the main frame is accessible from the outside, as well as also the frame is always accessible. By placing the insect screen on a separate frame the mounting is made completely independent of the present shaping of the main frame and the frame. The screen-carrying frame may, via its top-hinged connection, be attached directly to the outside of the top member of the main frame, for instance by means of mounting screws. The displaceable connection between the screen-carrying frame and the glass-carrying frame of the window permits mutual displacement between the two frames during the opening and closing of the window, which compensates for the axes of rotation of the two frames not being congruent.

The mounting of the screen-carrying frame on the window frame also offers the advantage that the screen will be spread out or folded up at the same time as the window is opened and closed, which partly has the advantage from an aesthetic point of view that the window is not disfigured by outside projecting objects when it is closed, partly the considerable practical advantage that the screen will be folded up and protected in for instance stormy weather, as the window is then closed.

In addition to the advantages with respect to the mounting obtained by placing the screen on the outside of the window, the further advantage is obtained that the screen does not disfigure the inside appearance of the window nor prevents an even diffusion of light in the room.

The screening arrangement also offers the advantage from a standardization point of view that the size of the screen only depends on the size of the window frame and not on whether the window is a pivoting, a top-hung or a side-hung window.

In one embodiment of the screening arrangement, the external frame is detachably attached to the main frame and frame members. With this design the entire external frame may, if desired, be removed along with the insect screen to avoid damages from snow or ice in the winter period, during which protection against insects is not required either.

The three wall-like sections of the insect screen are advantageously accommodated in a cavity on the external separate frame facing the main frame member, when the window is closed, which offers good protection of the screen against rain and wind.

The external separate frame may advantageously be designed as a plastic or metal profile to ease the production.

According to another embodiment of the screening arrangement, the screen-carrying frame has a screening which in its active position extends parallel to the plane of the external frame and covers the frame opening. The plane screening may be designed as a wind-tight screening, as the screen will offer sufficient ventilation in the sides, but may, of course, also be an air-permeable screen. The screening arrangement offers full insect screening, as the entire window outwardly is surrounded with protective material, which will also work as an advantageous sun screening for both top- and side-hung windows as wells as pivoting windows. In case of pivoting windows, the special advantage is obtained that both of the wedge-shaped ventilation apertures are completely screened against insects.

The external separate frame advantageously has additional cavities for mounting the plane screening, which may be attached on frame or list pieces which are inserted into the additional cavity or cavities.

The plane screening is preferably a roll-up screening, implying that it may very easily be placed in its active, unrolled position when protection is required. Irrespective of the type of window, the screening may be used as protection against sun light, both in the open ventilating position of the window and when the window is closed, while at the same time the possibility is offered to roll it up when sun screening is not required. The plane screening may be used either together with the screening in the sides or by itself in the seasons during which protection against insects is not required. In case of a top-hung window, the plane screening offers advantageous protection against sun light. The plane screening with its corresponding frame for mounting on the outside of the window may be produced and supplied as a separate unit, which subsequently may be supplemented with screening in the sides when the desire arises for protecting the wedge-shaped ventilation aperture or apertures.

BRIEF DESCRIPTION OF THE DRAWINGS

In the following, the invention will be explained in detail with reference to the attached drawing, in which.

DETAILED DESCRIPTION OF THE PREFERRED EMBODIMENTS

Figure 1:
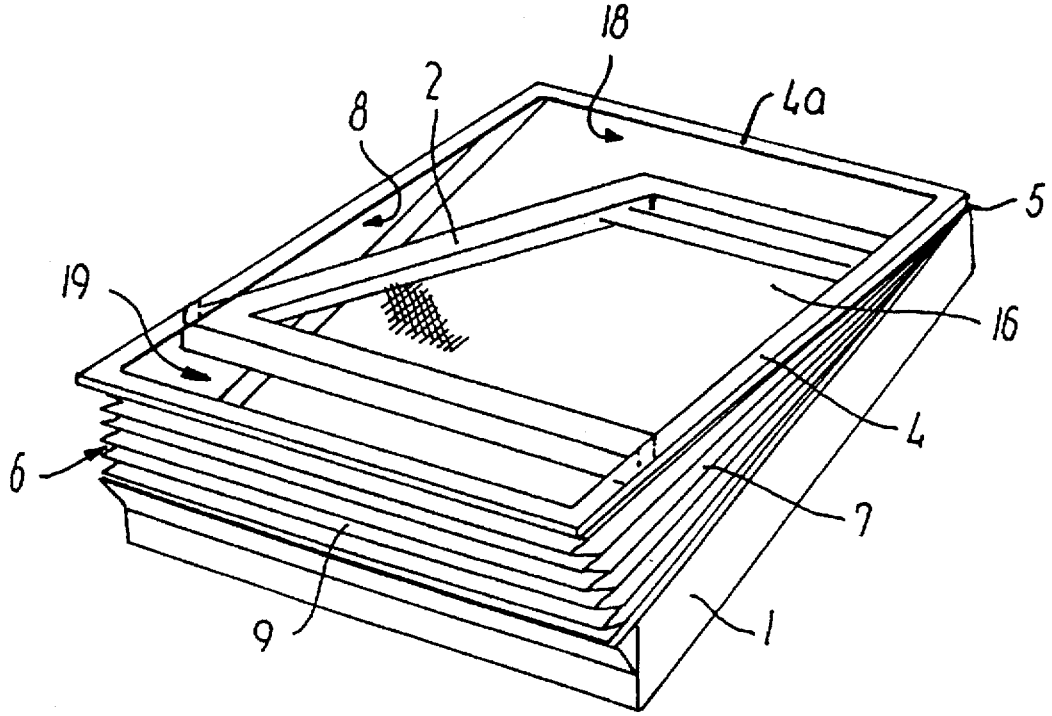
FIG. 1 is a perspective view of a screening arrangement in accordance with the invention, mounted on a pivoting window.
Figure 2:
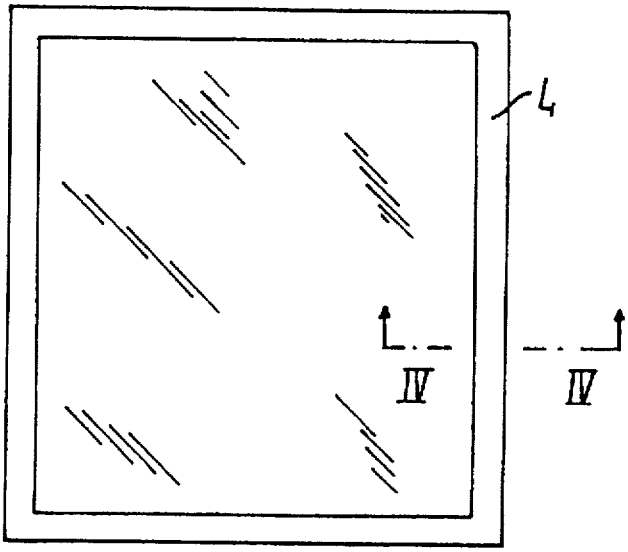
FIG. 2 is a plan view of the arrangement mounted on the window, FIG. 3 the bellows-shaped insect screen when the window is open, FIG. 4 a sectional view along the line IV—IV in FIG. 2, and FIG. 5 a sectional view showing a second embodiment of the screening arrangement in accordance with the invention.

FIG. 1 illustrates a window installed in an inclined roof, having a main frame 1 permanently built into the roof construction and a window frame 2 journalled on the main frame, which frame carries a window glass 3. In the illustration shown, the window frame 2 is designed as a pivotal frame, which at its central axis is journalled in the main frame, but could also be a top- or side-hung frame. In FIG. 1, the frame 2 has been opened to a ventilating position, in which the upper part of the window is turned inwards and the lower part outwards, forming two opposite wedge-shaped ventilation apertures marked 18 and 19.

An external frame 4 is at its upper side member 4*a* hinged to the upper main frame member of the top of the window by a not further illustrated insect-proof hinge 5, such as a continuous hinge of the piano type or a film hinge known per se. The external frame 4 carries in the remaining three sides a coherent insect screen 6, which screens the wedge-shaped aperture formed between the external frame 4 and the main frame 1. The insect screen 6 comprises two triangular screen sections 7,8 and one rectangular screen section 9, which is situated between and is integral with the two triangular sections 7,8 and is at right angles to these.

Figure 3:
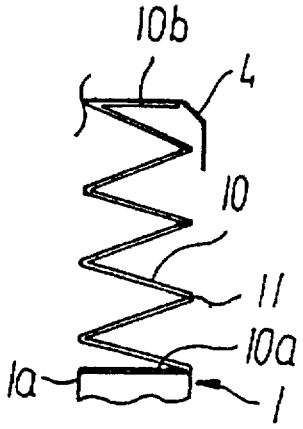

As it will appear from FIG. 3, each screen section is folded in alternately opposite directions, forming a bellows surface with narrow, elongated pleats or panels 10, which in themselves are mainly plane, but which at the longitudinal edges hang together through flexible areas 11, permitting the screen section to be pressed together to a position in which the panels are situated practically mutually parallel on top of each other and the screen section has a very low height and a breadth corresponding to the breadth of a panel, or to be stretched out until the panels are in one plane, end to end, and the screen section has a large height.

In case the screen is made from three separate sections, which after the folding are assembled to a whole screen, the assembly method is selected so that the height of the compressed screen is practically even, also in the corners in which the screen is assembled.

The inner end fold 10*a* of the pleats 10 is detachably attached to the main frame 1 by fitting 1*a* and likewise the outer end fold 10*b* is detachably attached to the frame 4. It is obvious that the attachment does not necessarily have to be made at the inner and outer end folds of the screen section, but could also be made some way into the screen section. As an example, the end folds of the screen may be attached on rails, which can be inserted into similar holding means in the frame and the main frame, respectively.

Figure 4:
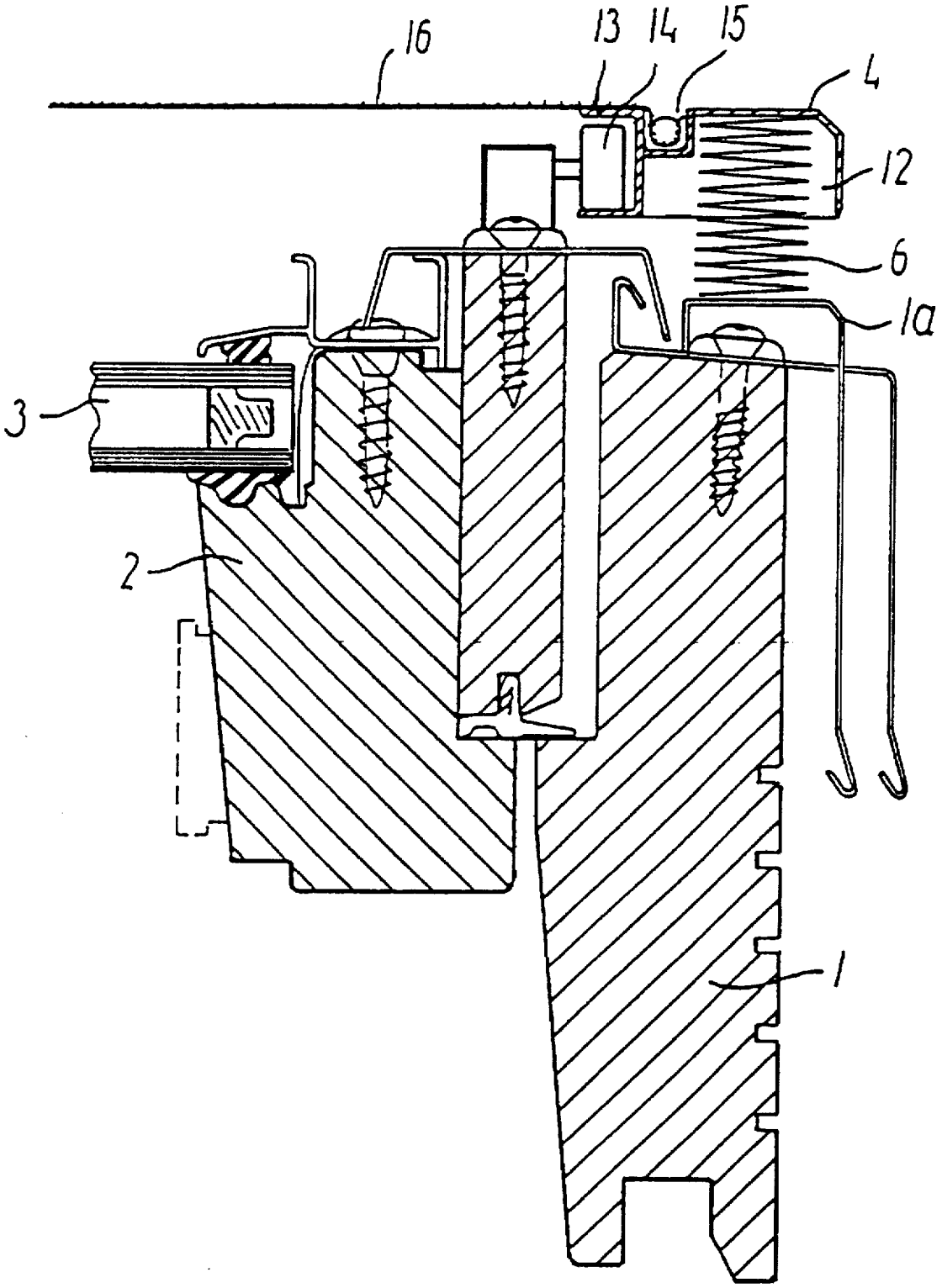
Figure 5:
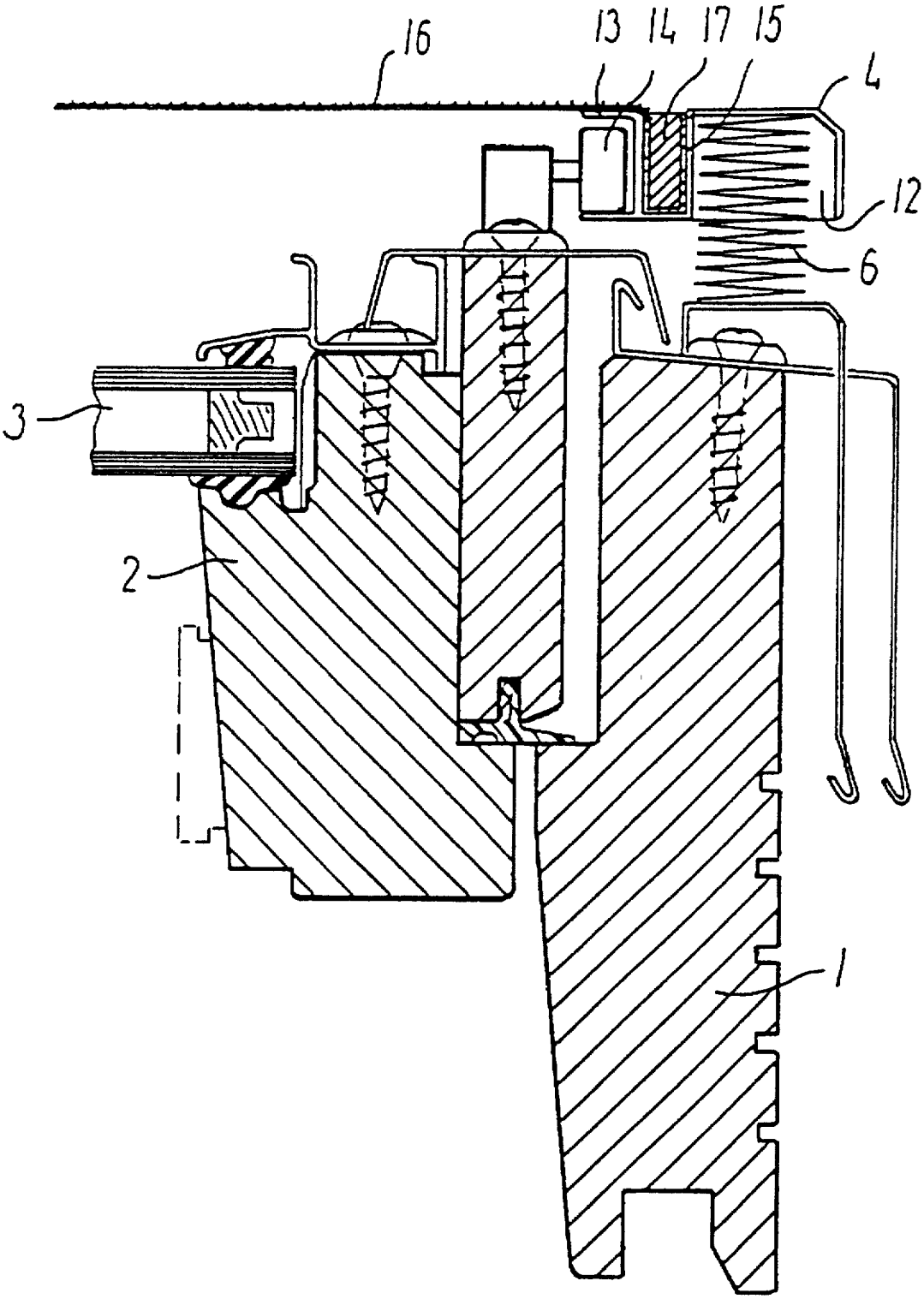

As illustrated in FIG. 4, the external frame 4 is designed as a profile with a cavity 12 for accommodating the folded insect screen 6 when the window is in its closed position. On the side facing the centre of the window, the profile has a U-shaped rail 13, in which a wheel 14 attached to the frame 2 can run when opening and closing the window, for providing the displaceable connection between the external frame 4 and the glass-carrying window frame 2.

On the outwardly facing side of the frame 4 there is an additional cavity 15 for accommodating the edges of a screening 16 situated in the plane of the frame 4. This screening 16 may be stretched on a detachable frame 17, which is inserted into the cavity 15, which in this case extends all the way round and along the frame 4, or be mounted on two list pieces, which are inserted into their respective cavities 15 in the two opposite side members of the window frame.

In another embodiment, the plane screening 16 is designed as a roll-up screening, which is guided along two sides in two cavities 15 situated opposite each other, as illustrated in FIG. 4, and which at one of the sides extending perpendicular to the screening is locked by means of a locking means. The roll-up screening comprises a non-illustrated spring roller tube, which is known from for instance roller blinds, and which is mounted on the side situated opposite the locking means.

The plane screening 16 may be completely wind-tight for protection against sun light or be designed as an air-permeable insect screen.

The invention is not limited to the above mentioned embodiment, but may, of course, be varied. The cavities in the external frame profile may, for instance, be designed differently, as well as the screen in the sides may be attached in different ways, for instance by gluing.

We claim:

1. A screening arrangement for a window with a frame-shaped main frame adapted for fixed installation in a roof or wall opening and a glass-carrying frame journalled in the main frame, wherein the glass-carrying frame from a closed position, in which the glass-carrying frame is in a plane parallel to that of the main frame, can be moved to a ventilating position, in which the glass-carrying frame plane forms an angle with the main frame plane, so that at least one wedge-shaped ventilation aperture having a rectangular face and two triangular side faces is defined between the main frame and the glass-carrying frame, said screening arrangement comprising an air-permeable insect screen, which in a mounted position comprises three wall-like sections for screening the rectangular and the two triangular side faces, respectively, of the wedge-shaped ventilation aperture, each section of the insect screen defining a bellows surface having an outer and an inner end fold, the inner end fold being connected with the main frame and the outer end fold being carried by a screen-carrying frame connected to the main frame by hinges to define a hinged connection, wherein the screen-carrying frame is a separate frame for mounting on the outside of the glass-carrying frame, and the screen-carrying frame, at a distance from its hinged connection with the main frame, is displaceably connected with the glass-carrying frame.

2. A screening arrangement according to claim 1, characterized in that the screen-carrying frame is detachably attached to the main frame.

3. A screening arrangement according to claim 1, wherein the three wall-like sections of the screen are received in a cavity on the external separate frame facing the main frame, when the window is closed.

4. A screening arrangement according to claim 1, wherein the screen-carrying frame is a plastic or metal profile.

5. A screening arrangement according to claim 1, wherein the screen-carrying frame has a screening which has an active position in which the screening extends parallel to the plane of the screen-carrying frame and covers the screen-carrying frame opening.

6. A screening arrangement according to claim 5, wherein the screen-carrying frame comprises at least one additional cavity for mounting the screening in the plane of the screen-carrying frame.

7. A screening arrangement according to claim 5, wherein the screening is a roll-up screening.

8. A screening arrangement according to claim 2, wherein the three wall-like sections of the screen are received in a cavity on the external separate frame facing the main frame, when the window is closed.

9. A screening arrangement according to claim 2, wherein the screen-carrying frame is a plastic or metal profile.

10. A screening arrangement according to claim 3, wherein the screen-carrying frame is a plastic or metal profile.

11. A screening arrangement according to claim 2, wherein the screen-carrying frame has a screening which has an active position in which the screening extends parallel to the plane of the screen-carrying frame and covers the screen-carrying frame opening.

12. A screening arrangement according to claim 3, wherein the screen-carrying frame has a screening which has an active position in which the screening extends parallel to the plane of the screen-carrying frame and covers the screen-carrying frame opening.

13. A screening arrangement according to claim 4, wherein the screen-carrying frame has a screening which has an active position in which the screening extends parallel to the plane of the screen-carrying frame and covers the screen-carrying frame opening.

14. A screening arrangement according to claim 6, wherein the screening is a roll-up screening.

* * * * *

UNITED STATES PATENT AND TRADEMARK OFFICE

CERTIFICATE OF CORRECTION

PATENT NO. : 5,694,996

DATED : December 9, 1997

INVENTOR(S) : Stig Flemming Vigenberg et al.

It is certified that error appears in the above-indentified patent and that said Letters Patent is hereby corrected as shown below:

Title page, column 1, item [86], the 371 Date should read --June 26, 1996--;

the 102(e) Date should read --June 26, 1996--;

Column 1, line 23, "From" should begin a new paragraph; and line 46, "The" should read --the--.

Signed and Sealed this

Twenty-fourth Day of February, 1998

*Attest:*

Bruce Lehman

BRUCE LEHMAN

*Attesting Officer*

*Commissioner of Patents and Trademarks*